US009321280B2

(12) United States Patent
Gracia Verdugo et al.

(10) Patent No.: US 9,321,280 B2
(45) Date of Patent: Apr. 26, 2016

(54) SPATIAL MISALIGNMENT OF A PRE-TREATMENT COMPOSITION RELATIVE TO AN INK COMPOSITION

(71) Applicant: HEWLETT-PACKARD DEVELOPMENT COMPANY, L.P., Houston, TX (US)

(72) Inventors: Antonio Gracia Verdugo, Barcelona (ES); Barret Kammerzell, Barcelona (ES); Joan Albert Jorba Closa, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/417,326

(22) PCT Filed: Oct. 24, 2012

(86) PCT No.: PCT/US2012/061677

§ 371 (c)(1),
(2) Date: Jan. 26, 2015

(87) PCT Pub. No.: WO2014/065793

PCT Pub. Date: May 1, 2014

(65) Prior Publication Data

US 2015/0246558 A1 Sep. 3, 2015

(51) Int. Cl.

| | |
|---|---|
| ***B41J 2/015*** | (2006.01) |
| ***B41J 11/00*** | (2006.01) |
| ***B41J 2/21*** | (2006.01) |

(52) U.S. Cl.

CPC ..... *B41J 11/0015* (2013.01); *B41J 2/2114* (2013.01)

(58) Field of Classification Search

None

See application file for complete search history.

(56) References Cited

U.S. PATENT DOCUMENTS

| | | | |
|---|---|---|---|
| 6,113,290 | A | 9/2000 | Tanaka et al. |
| 6,302,518 | B1 | 10/2001 | Kudo et al. |

(Continued)

FOREIGN PATENT DOCUMENTS

| | | |
|---|---|---|
| CN | 1178167 | 4/1998 |
| CN | 101909898 | 12/2010 |

(Continued)

OTHER PUBLICATIONS

Korean Intellectual Property Office, PCT Notification of Transmittal of the International Search Report and the Written Opinion of the International Searching Authority, or the Declaration for International Appl. No. PCT/US2012/061677 dated Apr. 29, 2013 (12 pages).

*Primary Examiner* — Bradley Thies
(74) *Attorney, Agent, or Firm* — HP Inc. Patent Department

(57) ABSTRACT

In the field of printing technology, non impact printing methods such as inkjet printing may be used to deposit an ink composition onto print media to form an image. An ink composition typically comprises a colorant material and a vehicle, such as an aqueous solution, for delivering the colorant material to the print media. A wide range of such ink compositions is known in the industry. It is also known to use various pre-treatment compositions in combination with ink compositions in order to enhance the quality of a final image. Pre-treatment compositions are often substantially colorless liquid compositions that interact with elements of the ink composition to fix colorant to the print media. Pre-treatment compositions may help to improve image quality for example by reducing image bleeding, edge roughness and other image quality issues.

15 Claims, 5 Drawing Sheets

(56) References Cited

U.S. PATENT DOCUMENTS

| | | | | |
|---|---|---|---|---|
| 6,474,778 | B1 | 11/2002 | Koitabashi et al. | |
| 6,513,924 | B1 | 2/2003 | Goldberg et al. | |
| 6,808,583 | B2 | 10/2004 | Kwasny et al. | |
| 7,033,013 | B2 | 4/2006 | Koyano et al. | |
| 8,220,899 | B2 | 7/2012 | Kato et al. | |
| 8,226,225 | B2 | 7/2012 | Yamanobe | |
| 2004/0170762 | A1 | 9/2004 | Newsome et al. | |
| 2006/0087540 | A1 | 4/2006 | Morimoto | |
| 2008/0055356 | A1 | 3/2008 | Yamanobe | |
| 2010/0295891 | A1 | 11/2010 | Goto et al. | |
| 2011/0025745 | A1* | 2/2011 | Izawa et al. | 347/14 |
| 2012/0128949 | A1 | 5/2012 | Goto | |

FOREIGN PATENT DOCUMENTS

| | | | | | |
|---|---|---|---|---|---|
| CN | 101952124 | | | 1/2011 | |
| JP | H09-141841 | | | 6/1997 | |
| JP | H10-157091 | | | 6/1998 | |
| JP | 2000-127357 | | | 5/2000 | |
| JP | 2001-018424 | | | 1/2001 | |
| JP | 2004237619 | A | * | 8/2004 | B41M 5/00 |
| JP | 2007-021891 | | | 2/2007 | |
| JP | 2008-055852 | | | 3/2008 | |
| JP | 2008246820 | | | 10/2008 | |
| JP | 2012-030520 | | | 2/2012 | |
| JP | 2012091505 | | | 5/2012 | |
| JP | 2012131102 | | | 7/2012 | |
| KR | 20040099252 | | | 11/2004 | |

* cited by examiner

SPATIAL MISALIGNMENT OF A PRE-TREATMENT COMPOSITION RELATIVE TO AN INK COMPOSITION

CROSS-REFERENCE TO RELATED APPLICATION

This application is a national stage application under 35 U.S.C. §371 of PCT/US2012/061677, filed Oct. 24, 2012, and incorporated herein by reference in its entirety.

BACKGROUND

In the field of printing technology, non impact printing methods such as inkjet printing may be used to deposit an ink composition onto print media to form an image. An ink composition typically comprises a colourant material and a vehicle, such as an aqueous solution, for delivering the colourant material to the print media. A wide range of such ink compositions is known in the industry. It is also known to use various pre-treatment compositions in combination with ink compositions in order to enhance the quality of a final image. Pre-treatment compositions are often substantially colourless liquid compositions that interact with elements of the ink composition to fix colourant to the print media. Pre-treatment compositions may help to improve image quality for example by reducing image bleeding, edge roughness and other image quality issues.

DETAILED DESCRIPTION

Figure 1A:
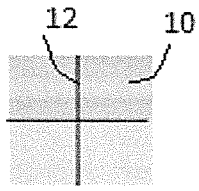
FIG. 1*a* illustrates an example of relative alignment between pre-treatment and ink composition printheads for printing of an image.

Before examples of the present invention are disclosed and described, it is to be understood that the examples are not limited to the particular components, process steps and materials disclosed herein because such components, process steps and materials may vary somewhat. It is also to be understood that the terminology used herein is used for the purpose of describing particular examples only. The terms are not intended to be limiting because the scope of the present invention is intended to be limited only by the appended claims and equivalents thereof.

It is noted that, as used in this specification and the appended claims, the singular forms "a," "an," and "the" include plural referents unless the context clearly dictates otherwise.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Measurements, amounts and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3.5, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

Unless otherwise stated, any feature described herein can be combined with any aspect or any other feature described herein.

As noted above, certain types of ink composition are designed for use in combination with a pre-treatment composition, which may be applied before the ink composition is deposited on a print medium. The pre-treatment composition interacts with elements of the ink composition and acts to fix colourant to the print medium, so preventing image bleeding, edge roughness and other image quality issues. Some ink compositions are particularly sensitive to the presence of a pre-treatment composition, meaning that the correct alignment of the pre-treatment with respect to the deposited ink composition is highly important to ensure acceptable quality images. Achieving perfect alignment of pre-treatment and ink compositions with each other requires very accurate alignment of pre-treatment and ink printheads according to an image to be printed.

Before ink composition is deposited onto a print medium, an image to be printed exists as a digital entity having both form and an intended location at which it will be printed on a print medium. Pre-treatment and ink composition print heads are aligned with respect to an image to be printed, such that the printheads deposit pre-treatment and ink compulsions in locations corresponding to the intended location of the image to be printed. Variability in printhead alignment processes and specifications mean that perfect alignment or positioning of the printheads cannot always be assured. Thus one or other of the printheads may be very slightly displaced from where it was intended to be according to the image to be printed. While such misalignment with respect to the intended position of the printheads may be extremely minor, and not sufficient to cause any distortion of the image, it can lead to image quality issues. If either one of the printheads is not perfectly aligned with the intended image location, then the deposited pre-treatment and ink compositions will not be perfectly aligned with each other, and ink composition may be deposited directly onto the print medium in some areas. Without the benefit of previously deposited pre-treatment composition in these areas, issues such as image bleeding and edge roughness can occur. In order to address such image quality issues, printing apparatus and methods have sought to improve the accuracy of printhead alignment equipment and processes.

The present inventors have discovered that improved image quality may be achieved through the application of a controlled misalignment to a deposited pre-treatment composition. The misalignment may for example be applied to a pre-treatment printhead during depositing of the pre-treatment composition, and may be applied with respect to the image to be printed, and hence with respect to the subsequently deposited ink composition. The misalignment may be substantially evenly distributed across axes and/or directions. The effect of a controlled misalignment between pre-treatment composition and ink composition may be to cause the pre-treatment composition to be deposited beyond the borders of an image to be printed. In this manner, it may be assured that no ink composition is deposited directly onto the print medium. Any minor variations in alignment of the pre-treatment or ink composition printhead or printheads are compensated for by the applied spatial misalignment of the pre-treatment printhead. Aspects of the present disclosure thus impart robustness to the printing process.

The effect achieved in extending beyond image borders may be similar to that observed in image blooming. Image blooming is a technique in which an ink composition may be deposited beyond the borders of an image to be printed. However, image blooming is conventionally achieved using a print mask, and requires the deposition of a fixed quantity of ink composition. This quantity is necessarily greater than would be required for printing the image alone. This means that the theoretical application of blooming techniques to a pre-treatment composition would not be a suitable way of addressing misalignment issues of a pre-treatment printhead. Blooming of a pre-treatment composition would deposit a fixed amount of pre-treatment composition onto a print medium. This fixed amount would not be in proportion to the amount of ink composition to be deposited over it. This mismatch between the quantity of pre-treatment composition and ink composition would likely lead to other image quality issues relating to coalescence and optical density.

Aspects of the present invention achieve improved image quality, without the problems that would be associated with using blooming techniques, through the application of a controlled misalignment to the pre-treatment composition. In some examples, a printing method may comprise depositing a pre-treatment composition onto a print medium and depositing an ink composition onto the print medium, substantially over the pre-treatment composition, wherein the pre-treatment composition is deposited with an applied spatial misalignment with respect to the ink composition. In this manner, allowance may be made for potential small inaccuracies in the positional alignment of a deposited pre-treatment composition or ink composition.

In some examples, the spatial misalignment of the pre-treatment composition may be applied in a first direction and in a second direction which is different to the first direction. In some examples, the first direction may extend along a first axis and the second direction may extend along one of the first axis and a second axis which is substantially perpendicular to the first axis. According to one example, the first and second axes may be axes of a printing apparatus such as a printer. For example, the first axis may be one of a scan axis or a print axis of a printer and the second axis may be the other of a scan axis or a print axis of a printer. In other examples, a printing apparatus may comprise a page wide array printer, and the first axis may comprise one of a print axis and a media width axis and the second axis may comprise the other of a print axis and a media width axis.

In some examples, the spatial misalignment of the pre-treatment composition may be applied in at least two directions extending along a first axis and in at least two directions extending along a second axis, wherein the second axis is substantially perpendicular to the first axis. In some examples, the first axis may be a scan axis and the second axis may be a print axis of a printing apparatus.

In some examples, a magnitude of the applied spatial misalignment may be substantially equal in each direction in which it is applied. A magnitude of the spatial misalignment may be measured for example in pixels or in dot rows.

In some examples, a computer program product may be provided for carrying out a method of printing with a printer. The printer may comprise or may be configured to accept installation of a pre-treatment printhead for depositing a pre-treatment composition. The method may comprise depositing a pre-treatment composition onto a print medium and depositing an ink composition onto the print medium. In some examples, the ink composition may be deposited according to an image to be printed and in some examples a spatial misalignment with respect to the image to be printed may be applied to the pre-treatment printhead during depositing of the pre-treatment composition.

In some examples, the applied spatial misalignment may cause the deposited pre-treatment composition to extend beyond boundaries of the image to be printed.

In some examples, the pre-treatment printhead may comprise first and second trenches, and the spatial misalignment may be distributed between the first trench and the second trench. In some examples, the spatial misalignment may be substantially evenly distributed between the first and second trenches In some examples, the first trench may be misaligned in a first direction and the second trench may be misaligned in a second direction which may be different to the first direction.

In some examples, each of the first and second trenches may be misaligned in two substantially perpendicular directions, and each direction of misalignment of the first trench may be substantially opposite to a direction of misalignment of the second trench. For example, one of the first or second trenches may be misaligned down in one axis and left in another axis, and another of the trenches may be misaligned up in the first axis and right in the other axis. The directions of misalignment may for example be along the scan and print axes of a printing apparatus on which the computer program product may be caused to run. In some examples, the computer program product may be caused to run on a printing apparatus. In other examples, the computer program product may be caused to run on a computing apparatus which may be arranged to control a printing apparatus. In other examples, a controller may be provided which is programmed according to the computer program product.

In some examples, a magnitude of the applied spatial misalignment may be substantially equal in each direction in which it is applied. A magnitude of the spatial misalignment may be measured for example in pixels or in dot rows.

In some examples a printer, which may be configured to accept installation of a pre-treatment printhead for depositing a pre-treatment composition and an ink printhead for depositing an ink composition may comprise a controller. In some examples, the controller may be configured to spatially align an ink printhead according to an image to be printed and to apply a spatial misalignment to a pre-treatment printhead with respect to the image to be printed. In some examples, a pre-treatment printhead and/or an ink printed may be installed in the printer. In other examples, the printer may for example be stored or shipped without the presence of a pre-treatment printhead or an ink printhead.

In some examples, the controller may be configured to generate initial pre-treatment printhead alignment values corresponding to the image to be printed, modify the initial pre-treatment printhead alignment values by the application of a misalignment factor, and align the pre-treatment printhead according to the modified alignment values.

In some examples, application of the misalignment factor may comprise adding the misalignment factor to the initial alignment values. The misalignment factor may for example be measured in dot rows or in pixels. The misalignment factor may for example be positive and/or negative according to a direction in which the misalignment is to be applied.

In some examples, the controller may be configured to apply the misalignment factor in at least two different directions. The directions may for example be along axes of the printer, such as a print axis and/or scan axis.

In some examples, the controller may be configured to apply a misalignment factor of substantially equal magnitude in each of the directions in which it is applied. In some examples, a misalignment factor of magnitude X dot rows may be applied in four directions. The misalignment factor may be +X to apply misalignment in a positive direction with respect to an axis, and may be −X to apply misalignment in a negative direction with respect to an axis.

In some examples, the printer may be configured to accept installation of a pre-treatment printhead which may comprise first and second trenches, and in some examples, the controller may be configured to apply a spatial misalignment to each of the first and second trenches in two substantially perpendicular directions. In some examples, each direction of misalignment of the first trench may be substantially opposite to a direction of misalignment of the second trench. In one example, a misalignment factor may be +X in a first axis and −X in a second axis for a first trench of the pre-treatment printhead, and may be −X in the first axis and +X in the second axis for second trench of the pre-treatment printhead.

The following examples illustrate a number of variations of the printing method, computer program product, printer and related aspects of the present disclosure. However, it is to be understood that the following are only illustrative of the application of the principles of the method, computer program product, printer and related aspects. Numerous modifications and alternatives may be devised without departing from the scope of the method, computer program product, printer and related aspects. The appended claims are intended to cover such modifications and arrangements. Thus, while the method, computer program product, printer and related aspects have been described above, the following examples provide further detail in connection with what are presently deemed to be acceptable manners in which the method, computer program product, printer and related aspects may be realised.

In one example, the present disclosure provides a printing method in which a pre-treatment composition is deposited onto a print medium and an ink composition is deposited onto the print medium substantially over the pre-treatment composition. According to the example, the pre-treatment composition is deposited with an applied spatial misalignment with respect to the ink composition. The ink composition may for example comprise liquid toners, dry toners, UV cured inks, thermally cured inks, inkjet inks, pigment inks, dye based inks, solvent based inks, water based inks, plastisols, or other appropriate solutions. The pre-treatment composition may for example comprise an aqueous solution or other vehicle enhanced with an active component such as a cationic polymer operable to provide the necessary increase in viscosity to fix colourant to the print media. Other components such as surfactants and dispersants may also be included in the pre-treatment composition.

Example methods described herein may be implemented in hardware, or as software modules running on one or more processors. The method may also be carried out according to the instructions of a computer program, and examples also provide a computer readable medium having stored thereon a program for carrying out any of the methods described herein. A computer program according to the present disclosure may be stored on a computer-readable medium, or it could, for example, be in the form of a signal such as a downloadable data signal provided from an Internet website, or it could be in any other form. The method may be performed by a printing apparatus for example according to computer readable instructions received from a computer program.

In another example, the present disclosure provides a computer program product for carrying out a method of printing with a printer. According to the present example, the printer comprises any suitable printing apparatus such as for example an inkjet printing apparatus. According to the example, the printer is configured to accept installation of a pre-treatment composition printhead for depositing a pre-treatment composition, and an ink printhead for depositing an ink composition. During printing, each printhead traverses across a print medium along a scan axis, depositing material on the print medium. As printing progresses; the print medium is moved relative to the printheads along a print axis which is substantially perpendicular to the scan axis, presenting fresh areas of the print medium for deposition of printing material. According to other examples, the printer may comprise a page wide array printer in which a medium wide array of printheads is provided and no scanning of the printheads is required.

According to the present example, the pre-treatment printhead comprises first and second trenches, each trench supplying pre-treatment composition for deposition onto a print medium. The deposition process may for example comprise forcing pre-treatment composition through ejection nozzles by thermal ejection, piezoelectric pressure or oscillation or any other suitable means. According to the present example, the printer is operable to conduct bidirectional printing, in which ink composition and pre-treatment composition may be deposited during both forward and reverse traverses of the printheads across the scan axis.

In the present example, the method carried out by the computer program product comprises depositing the pre-treatment composition onto a print medium and depositing the ink composition onto the print medium, substantially over the pre-treatment composition. According to the method, the ink composition is deposited according to an image to be printed and a spatial misalignment with respect to the image to be printed is applied to the pre-treatment printhead during depositing of the pre-treatment composition. According to the present example, the spatial misalignment is substantially evenly distributed between the first and second trenches of the pre-treatment printhead, with each trench misaligned in different first and second directions. The effect of this misalignment is to cause the deposited pre-treatment composition to extend beyond boundaries of the image to be printed, as explained in further detail with reference to FIGS. 1*a* to 3 below.

Figure 1B:
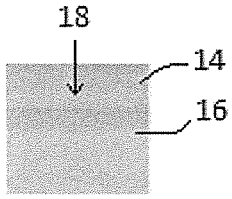
FIG. 1*b* illustrates an example of the resulting deposition of pre-treatment composition and ink composition following alignment as illustrated in FIG. 1*a*.

FIGS. 1*a* and 2*a* to 2*d* illustrate examples of relative alignment between pre-treatment and ink composition printheads for printing of an image. FIGS. 1*b* and 3 illustrate the resulting deposition of pre-treatment composition and ink composition. FIGS. 1*a* and 1*b* represent an idealised prior art situation, according to which the alignment between pre-treatment composition and ink composition printheads is perfect. This perfect alignment is represented in FIG. 1*a* by the perfect match up between the grey square 10, representing pre-treatment alignment, and the black cross 12, representing ink printhead alignment. The black cross represents a black ink printhead which according to this example is used as a reference printhead for all colour ink printheads which may be present. FIG. 1*b* illustrates the resulting printed image, in which pre-treatment composition 14 (light grey) and ink composition 16 (dark grey) are perfectly aligned, resulting in a perfectly clear image of a square 18. In reality, as discussed above, variability in printhead alignment processes and specifications mean that this perfect alignment cannot always be assured, and, using the example of FIG. 1*b*, the pre-treatment and ink composition squares may be slightly out of alignment, resulting in some areas in deposition of ink composition directly onto print medium and consequent image quality problems.

Figure 2A:
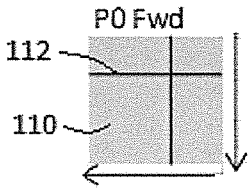
FIGS. 2*a* to 2*d* illustrate examples of relative alignment between pre-treatment and ink composition printheads for printing of an image.
Figure 2C:
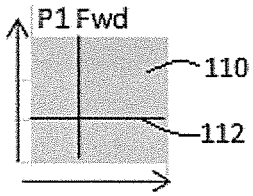
Figure 2B:
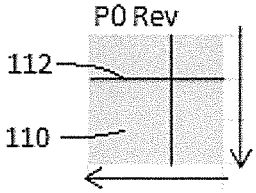
Figure 2D:
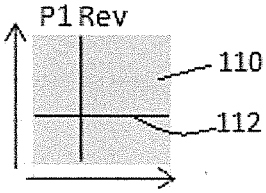
Figure 3:
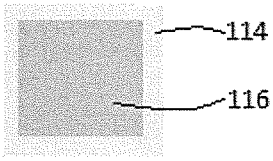
FIG. 3 illustrates an example of the resulting deposition of pre-treatment composition and ink composition following alignment as illustrated in FIGS. 2*a* to 2*d*.

FIGS. 2*a* to 2*d* represent relative alignment of first and second trenches of the pre-treatment printhead with respect to subsequent ink deposition according to the present example. FIG. 2*a* represents relative alignment of a first trench P0 travelling in a forward scan direction. FIG. 2*b* represents relative alignment of the first trench P0 travelling in a reverse scan direction. FIG. 2*c* represents relative alignment of a second trench P1 travelling in a forward scan direction. FIG. 2*d* represents relative alignment of the second trench P1 travelling in a reverse scan direction.

As illustrated in the Figures, the first trench P0 is misaligned with respect to the subsequent ink deposition both down in the print axis and to the left in the scan axis. This can be seen by the relative movement of the grey square 110 representing the trench of the pre-treatment printhead, with respect to the black cross 112 representing ink printhead alignment. This misalignment of the pre-treatment printhead trench is applied in both the forward and reverse scan directions. In contrast, the second trench P1 is misaligned upwards in the print axis and to the right in the scan axis. As for the first trench, this misalignment is applied both in the forward and reverse scan directions.

FIG. 3 illustrates the deposition of pre-treatment and ink compositions resulting from the printhead trench alignments represented in FIGS. 2*a* to 2*d*. As can be seen in the Figure, deposited pre-treatment composition 114 extends beyond the borders of the deposited ink composition 116 in four directions, up and down in a print axis and left and right in a perpendicular scan axis. The effect of this applied misalignment is to ensure that any minor variation in printhead alignment values, either for the pre-treatment printhead or the ink composition printhead, are accounted for in the applied misalignment. According to the illustrated example, the magnitude of the applied misalignment is selected such that it is likely to be greater than any potential alignment variation. For example, the applied misalignment may be of the order of about 4 to 16 dot rows, and for example about 4 to 6 dot rows in plus and minus directions, thus easily compensating for potential variations in alignment owing to printhead specifications or alignment processes, which may be of the order of about 1 to 3 dot rows.

Figure 4:
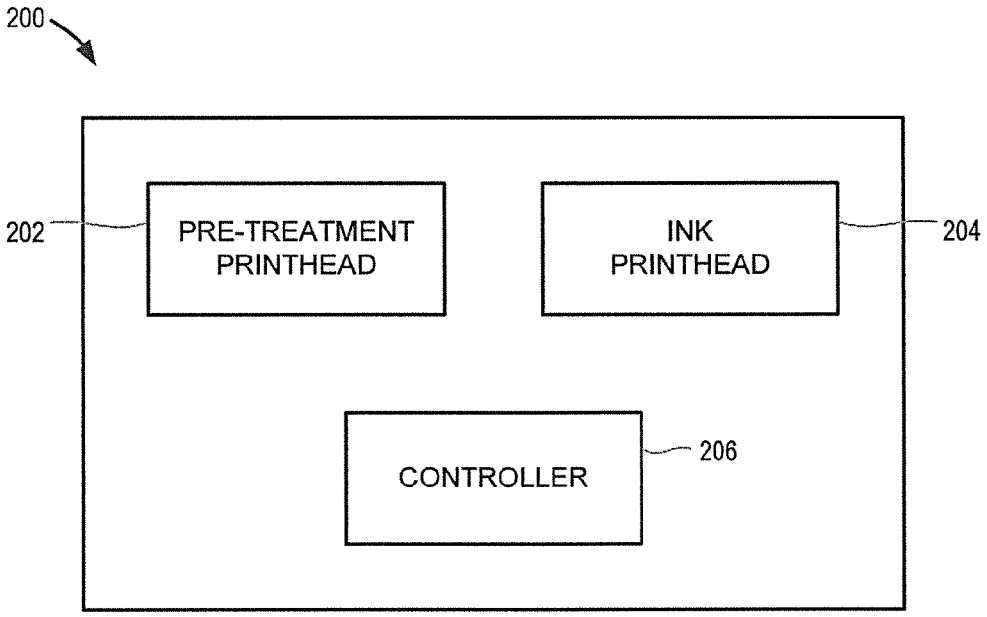
FIG. 4 illustrates functional units of an example of a printing apparatus.

With reference to FIG. 4, in another example, the present disclosure provides a printer 200 comprising a controller 206. The printer 200 is configured to accept installation of a pre-treatment printhead 202 and an ink printhead 204. The printer 200 is illustrated in FIG. 4 with the pre-treatment printhead 202 and the ink printhead 204 installed but may for example be manufactured, stored and transported without the pre-treatment and ink printheads installed. The units illustrated in FIG. 4 are functional units, and may be realised in any combination of hardware and/or software. The pre-treatment printhead 202 is configured to deposit a pre-treatment composition, which may be any suitable pre-treatment composition as discussed above. According to the illustrated example, the pre-treatment printhead 202 comprises first and second trenches, each of which is operable for delivery of pre-treatment composition. The ink printhead 204 is configured to deposit an ink composition, and may also comprise first and second trenches for delivery of the ink composition.

According to the example, the controller 206 is configured to spatially align the ink printhead 204 according to an image to be printed and to apply a spatial misalignment to the pre-treatment printhead with respect to the image to be printed. In one example, the controller may follow a process 300 substantially as illustrated in FIG. 5 for aligning the ink and pre-treatment printheads 204, 202.

Figure 5:
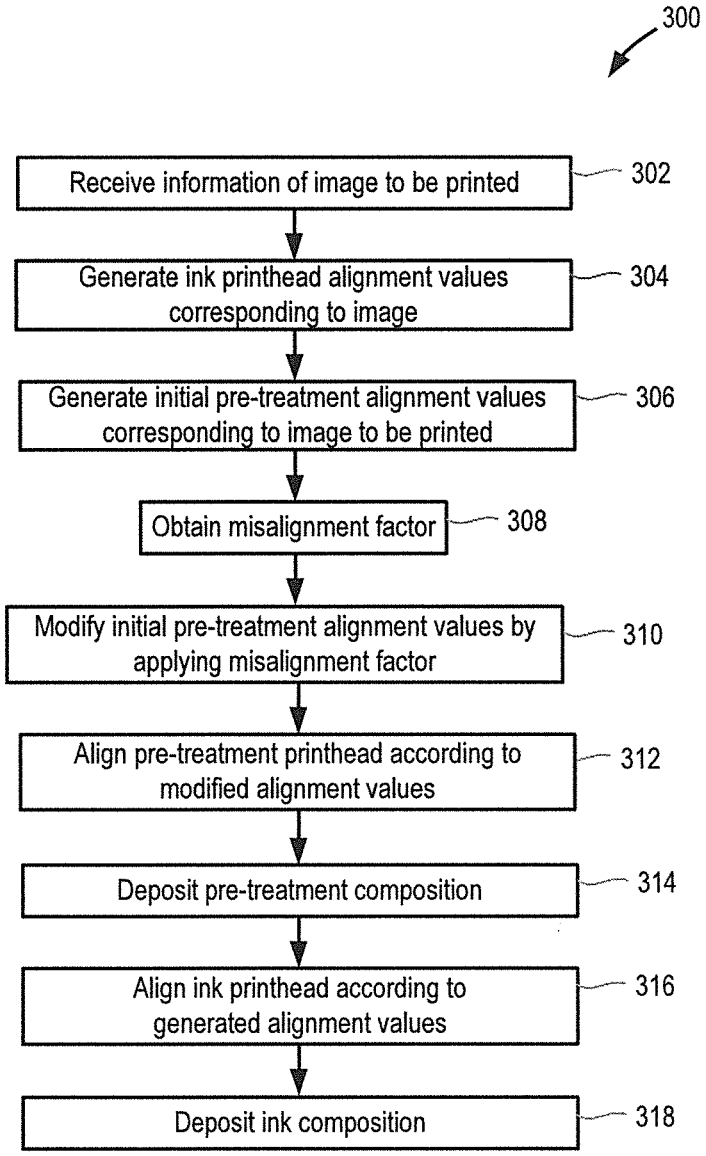
FIG. 5 is a flow chart illustrating steps in an example of a process which may be followed by a controller.

With reference to FIG. 5 and in accordance with one example, in a first step 302, the controller 206 receives information concerning an image to be printed. In a subsequent step 304, the controller generates alignment values for the ink printhead 204. The alignment values may include for example separate values for each trench of the ink printhead 204 and for both the forward and reverse directions of travel along the scan axis during bidirectional printing. The alignment values for the ink printhead 204 correspond to the image to be printed, such that the ink printhead will be positioned to deposit ink composition so as to create the required image. In a next step 306, the controller 206 generates initial alignment values for the pre-treatment printhead 202. The initial values also correspond to the image to be printed, such that the pre-treatment printhead positioned according to the initial values would deposit pre-treatment composition exactly over the area of the image to be printed. As discussed above with respect to the ink printhead, the alignment values may include specific values for each trench of the printhead and for the forward and reverse traverses of the printhead across the scan axis.

After generating the initial pre-treatment printhead alignment values, the controller then, at step 308, obtains a misalignment factor. The misalignment factor may be calculated by the controller or may be retrieved from a memory. In one example, the controller may calculate the misalignment factor according to particular printing parameters such as the size of the image to be printed or the nature of the pre-treatment and ink compositions to be used. In another example, a misalignment factor or a range of possible misalignment factors may be predetermined and stored in a memory accessible to the controller, for example by a manufacturer of the printer. The controller may then at step 308 retrieve a stored misalignment factor form the memory. In the case of a range of stored misalignment factors, the controller may select the most appropriate misalignment factor for the current printing parameters, including size of image to be printed, nature of pre-treatment and ink compositions to be used, etc.

In some examples, the misalignment factor may comprise a family of misalignment factors for application to a specific trench of the pre-treatment printhead, a particular axis of alignment and/or a specific direction of travel along the scan axis. A misalignment factor may for example be measured in pixels or in dot rows. One example of a family of misalignment factors could be +/−8 dot rows out of 600 in the scan axis and +/−8 dot rows out of 1200 in the print axis. This could equate to a shift of a first trench by +8 dot rows in the scan axis and −8 dot rows in the print axis, and a shift of a second trench by −8 dot rows in the scan axis and +8 dot rows in the print axis. In this manner, each trench is shifted in a direction along both the scan and print axes which is opposite to the direction of shift of the other trench in the respective scan and print axes. In some examples, the misalignment factor may be calculated or predetermined to be at least equal in magnitude to a likely alignment variation owing to specifications or alignment processes. For example, a misalignment factor of +/−8 dot rows may be selected to be greater than a likely alignment variation of +/−4 dot rows that may be experienced as a result of particular printhead specifications or alignment processes.

Having obtained a suitable misalignment factor in step 308, the controller proceeds at step 310 to modify the initial alignment values for the pre-treatment printhead 202 by applying the obtained misalignment factor. The process of applying the misalignment factor may for example comprise adding the misalignment factor to the alignment values. This may have the effect of shifting the alignment values in a positive or negative direction, depending upon the sign of the misalignment factor. As discussed above, the misalignment factor may comprise a family of misalignment factors for application to particular trenches, axes of alignment and/or direction of travel along an axis.

After modifying the alignment values for the pre-treatment printhead at step 310, the controller proceeds, at step 312 to align the pre-treatment printhead according to the modified alignment values, and to cause the pre-treatment printhead to deposit pre-treatment composition at step 314. The controller then proceeds to align the ink printhead according to the generated ink printhead alignment values at step 316 and to cause the ink printhead to deposit ink composition at step 318.

In variations to the illustrated example, certain steps discussed above may be performed in a different order to that illustrated. For example, the order in which the controller generates alignment values for the ink printhead and the pre-treatment printhead may be reversed, and the controller 206 may initially calculate alignment values for the pre-treatment printhead, and then subsequently generate alignment values for the ink printhead.

Figure 6A:
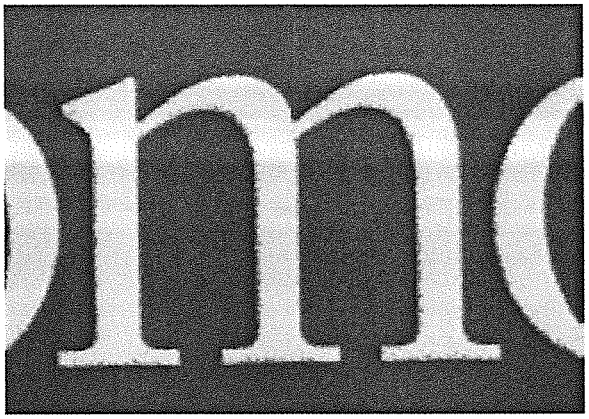
FIG. 6*a* illustrates an example of text printed according to known techniques.
Figure 6B:
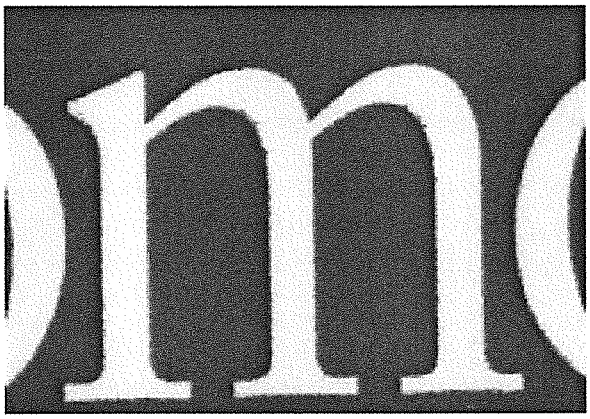
FIG. 6*b* illustrates the text of FIG. 6*a* printed according to aspects of the present disclosure.
Figure 7A:
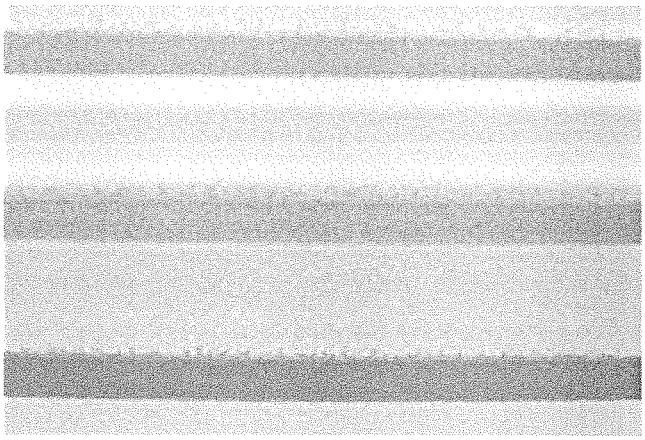
FIG. 7*a* illustrates an example of graphic elements printed according to known techniques.
Figure 7B:
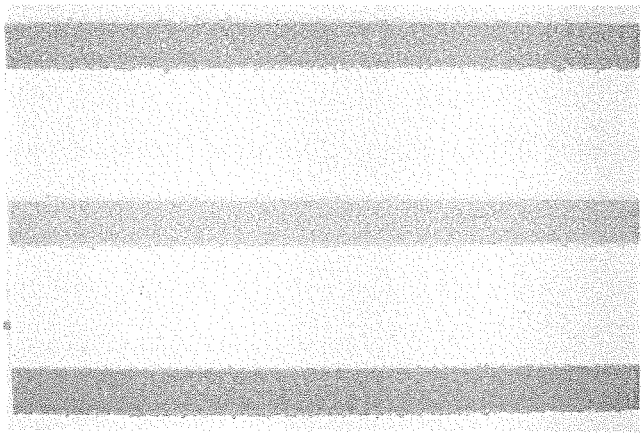
FIG. 7*b* illustrates the graphic elements of FIG. 7*a* printed according to aspects of the present disclosure.

FIGS. 6*a*, 6*b*, 7*a* and 7*b* illustrate examples of improvements in image quality which may be obtained according to aspects of the present disclosure. FIGS. 6*a* and 7*a* illustrate examples of text and graphic elements printed according to known techniques using inks requiring application of pre-treatment composition before deposition of ink composition. Pre-treatment printheads were aligned to correspond to the image to be printed. As discussed above, minor variations in printhead specification and/or alignment processes have resulted in a slight mismatch between the deposited pre-treatment composition and the deposited ink composition. In some areas, this mismatch has resulted in direct deposition of ink composition onto the print medium, leading to undesirable edge roughness in these areas. In contrast, FIGS. 6*b* and 7*b* illustrate the same text and graphic elements printed according to aspects of the present disclosure. A spatial misalignment was applied to the deposited pre-treatment composition with respect to the ink composition forming the printed image. In the illustrated example, the spatial misalignment was applied in both positive and negative directions along both the scan and print axes. The resulting images can be seen to have improved edge roughness when compared to the images printed according to known techniques.

While the printing method, printer, computer program product and related aspects have been described with reference to certain examples, various modifications, changes, omissions, and substitutions can be made without departing from the spirit of the present disclosure. It is intended, therefore, that the printing method, printer, computer program product and related aspects be limited only by the scope of the following claims and their equivalents. The features of any dependent claim may be combined with the features of any of the independent claims or other dependent claims.

The invention claimed is:

1. A method comprising:

determining, by a controller, a spatial misalignment for application of a pre-treatment composition onto a print medium relative to an ink composition, the determining of the spatial misalignment comprising calculating a misalignment factor that varies according to a size of an image to be printed and according to characteristics of the pre-treatment composition and the ink composition;

depositing the pre-treatment composition onto the print medium;

depositing the ink composition onto the print medium, over the pre-treatment composition, wherein the pre-treatment composition is deposited with the spatial misalignment relative to the ink composition; and receiving, by the controller, an expected alignment variation between a pre-treatment printhead that deposits the pre-treatment composition and an ink printhead that deposits the ink composition, wherein a magnitude of the misalignment factor is determined further based on the received expected alignment variation.

2. A method as claimed in claim 1, wherein the spatial misalignment of the pre-treatment composition is applied in a first direction and in a second direction different from the first direction.

3. A method as claimed in claim 2, wherein the first direction extends along a first axis and the second direction extends along one of the first axis and a second axis that is substantially perpendicular to the first axis.

4. A method as claimed in claim 1, wherein the spatial misalignment of the pre-treatment composition is applied in at least two directions extending along a first axis and in at least two directions extending along a second axis, wherein the second axis is substantially perpendicular to the first axis.

5. A method as claimed in claim 1, wherein a magnitude of the applied spatial misalignment is substantially equal in each direction in which the spatial misalignment is applied.

6. A method as claimed in claim 1, wherein different values are calculated for the misalignment factor for different sizes of the image to be printed.

7. A non-transitory computer readable storage medium storing instructions that upon execution cause a printer to:

determine a spatial misalignment for application of a pre-treatment composition onto a print medium relative to an ink composition, the determining of the spatial misalignment comprising calculating a misalignment factor that varies according to a size of an image to be printed and according to characteristics of the pre-treatment composition and the ink composition;

cause a pre-treatment printhead of the printer to deposit the pre-treatment composition, with the determined spatial misalignment, onto the print medium; and cause an ink printhead of the printer to deposit, onto the print medium, the ink composition according to the image to be printed onto the print medium;

receive an expected alignment variation between the pre-treatment printhead and the ink printhead, wherein a magnitude of the misalignment factor is determined further based on the received expected alignment variation.

8. A non-transitory computer readable storage medium as claimed in claim 7, wherein application of the determined spatial misalignment causes the deposited pre-treatment composition to extend beyond boundaries of the image to be printed.

9. A non-transitory computer readable storage medium as claimed in claim 7, wherein the pre-treatment printhead comprises first and second trenches, and wherein the spatial misalignment is distributed between the first trench and the second trench.

10. A non-transitory computer readable storage medium as claimed in claim 9, wherein the first trench is misaligned in a first direction and the second trench is misaligned in a second direction different from the first direction.

11. A non-transitory computer readable storage medium as claimed in claim 9, wherein each of the first and second trenches is misaligned in two substantially perpendicular directions, and wherein each direction of misalignment of the first trench is substantially opposite to a direction of misalignment of the second trench.

12. A non-transitory computer readable storage medium as claimed in claim 7, wherein a magnitude of the determined spatial misalignment is substantially equal in each direction in which the spatial misalignment is applied.

13. A printer configured to accept installation of a pre-treatment printhead for depositing a pre-treatment composition and an ink printhead for depositing an ink composition, the printer comprising a controller which is configured to spatially align the ink printhead according to an image to be printed and to apply a spatial misalignment to the pre-treatment printhead with respect to the image to be printed, wherein the controller is configured to:

generate initial pre-treatment printhead alignment values corresponding to the image to be printed;

modify the initial pre-treatment printhead alignment values by the application of a misalignment factor that varies according to a size of the image to be printed and according to characteristics of the pre-treatment composition and the ink composition;

align the pre-treatment printhead according to the modified alignment values; and receive an expected alignment variation between the pre-treatment printhead and the ink printhead, wherein a magnitude of the misalignment factor is determined further based on the received expected alignment variation.

14. A printer as claimed in claim 13, wherein the controller is configured to apply the misalignment factor in at least two different directions.

15. A printer as claimed in claim 13, wherein the controller is configured to apply the misalignment factor in each of plural directions.

* * * * *